United States Patent [19]

Manor

[11] 4,388,770

[45] Jun. 21, 1983

[54] IDENTIFICATION BADGE

[76] Inventor: Sissy J. Manor, 10113 Goshen Rd., Fort Wayne, Ind. 46802

[21] Appl. No.: 307,004

[22] Filed: Sep. 30, 1981

Related U.S. Application Data

[63] Continuation-in-part of Ser. No. 295,725, Aug. 20, 1981, abandoned.

[51] Int. Cl.[3] ..... A44C 3/00

[52] U.S. Cl. ..... 40/1.6

[58] Field of Search ..... 40/1.5, 1.6, 10 D, 586, 40/16.4, 16; 150/39

[56] References Cited

U.S. PATENT DOCUMENTS

| | | | |
|---|---|---|---|
| 1,824,918 | 9/1931 | Nelson et al. | 40/5 |
| 2,364,870 | 11/1944 | Otto | 40/1.6 |
| 2,441,002 | 5/1948 | Berglund | 40/1.6 |
| 2,972,826 | 2/1961 | Newell | 40/1.5 |
| 3,054,201 | 9/1962 | Burns | 40/1.5 |
| 3,500,568 | 3/1970 | Hushek | 40/1.6 |
| 3,536,116 | 10/1970 | Margilis | 150/36 |
| 4,000,570 | 1/1977 | Carmen | 40/1.5 |
| 4,098,014 | 7/1978 | Lauer et al. | 40/1.5 |

FOREIGN PATENT DOCUMENTS

| | | | |
|---|---|---|---|
| 675902 | 12/1963 | Canada | 40/5 |

*Primary Examiner*—Robert A. Hafer
*Assistant Examiner*—Wenceslao J. Contreras
*Attorney, Agent, or Firm*—David A. Lundy

[57] ABSTRACT

An identification badge for detachable attachment to a wearer comprising a generally planar member having opposite surfaces. One of these surfaces faces outwardly from the wearer. A means is secured to the member for detachably attaching the badge to the wearer. A transparent pocket is formed in the outwardly facing surface. An identification member is removably positionable within the pocket so as to indicate the identity of the wearer.

12 Claims, 8 Drawing Figures

IDENTIFICATION BADGE

RELATED APPLICATION

This is a continuation-in-part application of U.S. patent application entitled "Identification Badge" mailed on Aug. 20, 1981, Ser. No. 295,725, now abandoned.

BACKGROUND OF THE INVENTION

The invention relates to identification badges, and in particular, to an identification badge for detachable attachment to a wearer.

Heretofore, identification badges have been utilized in various sporting and athletic contests to identify the contestants. Some of these badges have been disposable or made of such materials (e.g. paper, cardboard, and the like) that did not render them permanent. Because of the expense associated with the use of a number of dispensable badges, it would be highly desirable to provide an identification badge that is relatively inexpensive to manufacture and yet is permanent.

Some of the identification badges heretofore utilized have presented only one fixed identity, and are incapable of presenting a selected one of a number of possible identities. Thus, it would be highly desirable to provide an identification badge that can present a selected one of a number of possible identities.

An identification badge for use by contestants in sporting and athletic contests should not interfere with the actions of the contestants. If the badge did interfere, the performance of the contestant could be impaired. Thus, it would be highly desirable to provide an identification badge that does not interfere with the activities of the contestant.

An identification badge for use by contestants in sporting and athletic contests should be easily visible from a reasonable distance away. The accurate identification of contestants is important to spectator enjoyment of the event. Further, such accurate identification facilitates a judge in giving proper credit to the contestants. Thus, it would be highly desirable to provide an identification badge that is easily visible from a reasonable distance away.

Thus, it is an object of the invention to provide an improved identification badge for detachable attachment to a wearer.

It is another object of the invention to provide an improved identification badge for detachable attachment to a wearer that is relatively inexpensive to manufacture and yet is permanent.

It is another object of the invention to provide an improved identification badge for detachable attachment to a wearer that provides for the presentation of a selected one of a number of possible identities.

It is another object of the invention to provide an improved identification badge for detachable attachment to a wearer that does not interfere with the activities of the contestant.

Finally, it is an object of the invention to provide an improved identification badge for detachable attachment to a wearer that is easily visible from a reasonable distance away.

The invention is an identification badge for detachable attachment to a wearer. The badge comprises a generally planar member having opposite surfaces wherein one of the surfaces faces outwardly from the wearer. A means is secured to the member for detachably attaching the badge to the wearer. A transparent pocket is formed in the outwardly facing surface. An identification member is removably positionable within the pocket so as to indicate the identity of the wearer.

BREIF DESCRIPTION OF THE DRAWINGS

The above mentioned and other features and objects of this invention and the manner of attaining them will become more apparent and the invention itself will be best understood by reference to the following description of the invention taken in conjunction with the accompanying drawings wherein.

Figure 1:
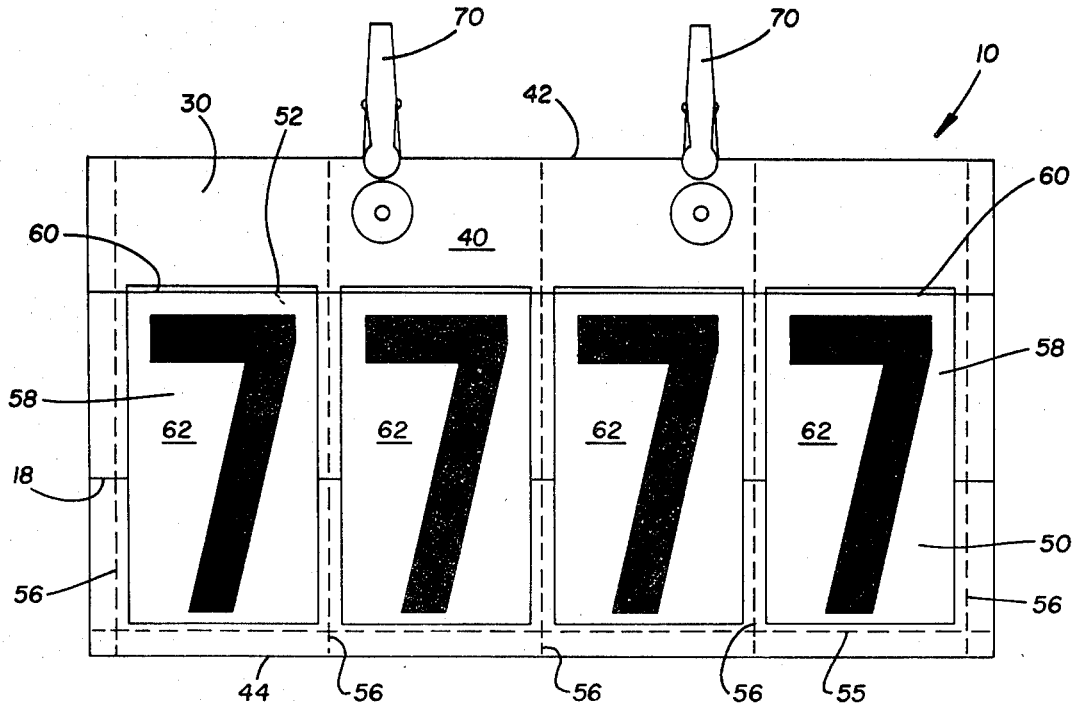
FIG. 1 is a perspective view of the outwardly facing surface of a specific embodiment of the invention.
Figure 2:
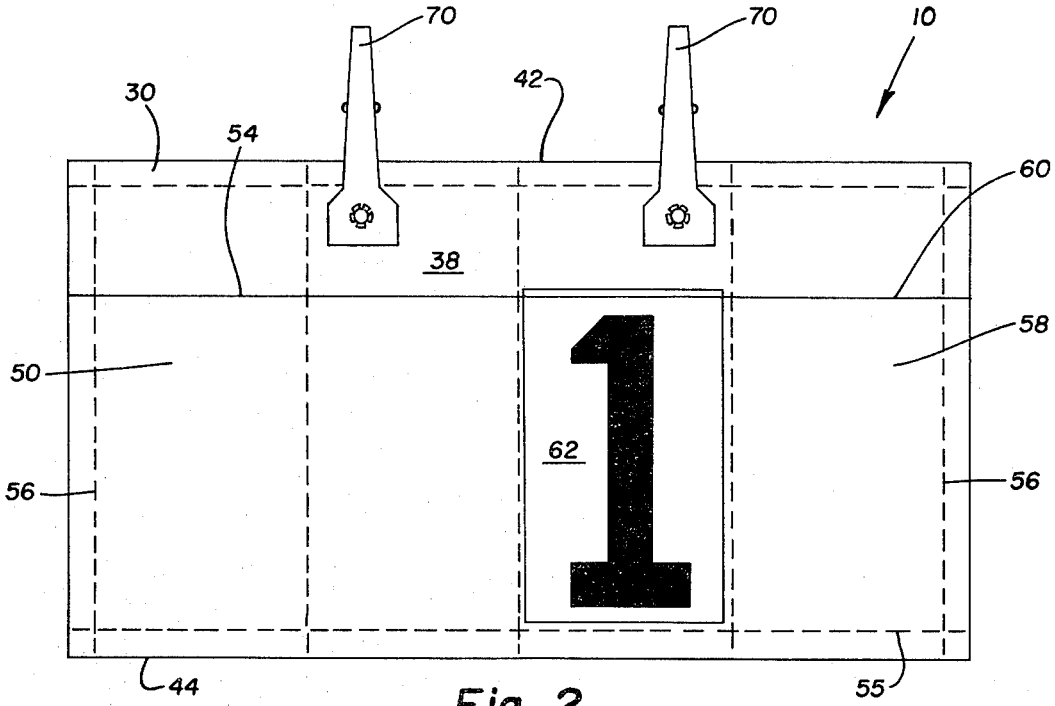
FIG. 2 is a perspective view of the inwardly facing surface of the specific embodiment of FIG. 1.
Figure 4A:
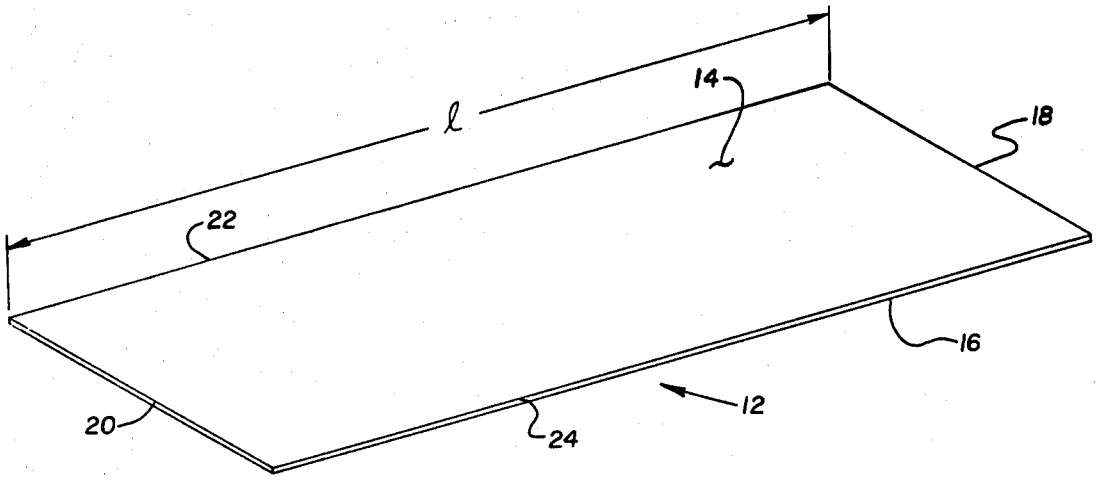
Figure 4B:
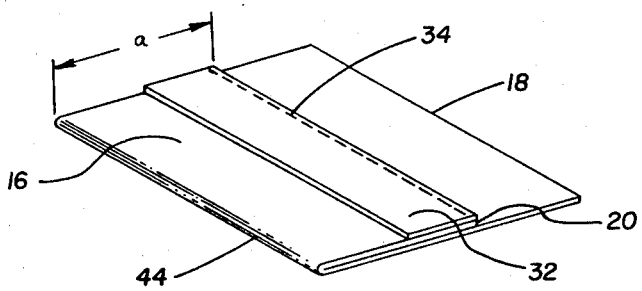
Figure 4C:
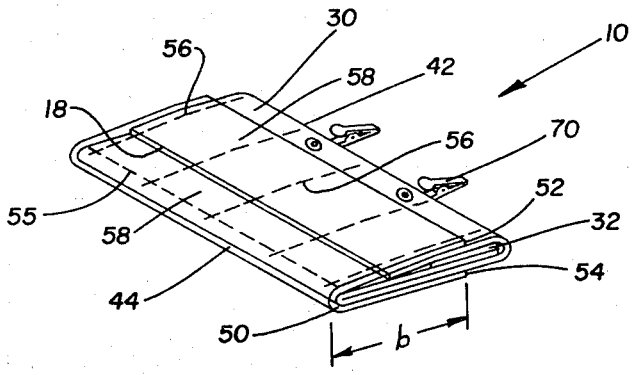

FIGS. 4A, 4B, and 4C are perspective views of the steps comprising the process utilized to construct the specific embodiment illustrated in FIG. 1; and FIGS. 5 and 6 are perspective views similar to FIGS. 1 and 2 of a modified identification badge of the invention.

DETAILED DESCRIPTION OF A SPECIFIC EMBODIMENT

Referring to the Figures, there is illustrated an identification badge generally designated as 10. Badge 10 is comprised of a generally rectangularly-shaped pliant sheet 12. Sheet 12 has oppositely facing surfaces 14 and 16, opposite end edges 18 and 20, and opposite side edges 22 and 24. Sheet 12 can be made from a wide variety of pliant materials having acceptable durability and washability. The specific embodiment is made from a pliant sheet of vinyl material.

The basic planar member 30 of the specific embodiment is constructed by folding end edge 20 over surface 14. The length "a" of the fold should be equal to between approximately thirty-five percent and approximately forty-five percent of the length "1" of the sheet. A reinforcing member 32 is positioned adjacent end 20 and on surface 16 that is folded over. Reinforcing member 32 and sheet 12 are stitched together along line 34. End 18 is folded over reinforcing member 32 as illustrated in FIG. 4C. This structure comprises the basic planar member 30 of the specific embodiment.

It is now apparent that planar member 30 has opposite surfaces. One surface 38 of which facesinwardly towards the wearer when attached. The other surface 40 of which faces outwardly from the wearer when attached. Planar member 30 further includes a top edge 42 and a bottom edge 44.

A transparent plastic sheet 50 envelopes bottom edge 44 so that the opposite side edges 52, 54 are positioned approximately a distance "b" from edge 44. The combination of the planar member and transparent sheet is stitched along line 55 and lines 56 so that a plurality of transparent pockets 58 are formed in both the inwardly and outwardly facing surfaces of the planar member. Each pocket has an open end 60 which provides access to and from pocket 58.

A plurality of identification members 62 are removably positionable within pockets 58. These identification members comprise numerals so that in specific embodiment illustrated, only one number from zero through 9,999 can be positioned within the pockets.

Thus, the identity of the wearer can be presented, and is generally done so via outwardly facing surface 40.

In a situation where a wearer would require two different identifications, inwardly facing surface 38 also provides pockets 58 which receive identification members 62. Thus, a selected one of a plurality of identities can be presented by outwardly facing surface 40 and a second selected one of a plurality of identities can be presented by inwardly facing surface 38.

A pair of clips 70 are secured to planar member 30 adjacent top edge 42 thereof.

The materials utilized in the manufacture of the identification badge are such that the badge can be easily washable with a sponge or the like. The identification badge is pliant so that upon attachment to the wearer it depends downwardly from the point of attachment. If, for example, the badge is clipped to the clothes of the wearer, it should depend downwardly in a position so as to not interfere with the activities of the wearer, and because of its pliant nature also continuously presents the identity of the wearer. The contrast between the numerical identifications and the background of the badge provides for easy visibility of the identification from a reasonable distance away.

FIGS. 1 and 2 illustrate an identification badge of the invention. FIGS. 5 and 6 illustrate a modified identification badge of the invention. The difference between the badge of FIGS. 1 and 2 and the badge of FIGS. 5 and 6 is that the clips 70 are fastened with the thumb lever adjacent surface 38 in FIGS. 1 and 2 and adjacent surface 40 in FIGS. 5 and 6.

The method of making identification badge 10 is specifically illustrated by FIGS. 4A, 4B and 4C, although reference to the remaining figures will certainly prove helpful. After sheet 12 is positioned flat on a surface, the first step comprises folding end edge 20 over surface 14 so that the length "a" of the fold is equal to between approximately thirty-five percent and approximately forty-five percent of the length "1" of the sheet. The second step comprises positioning reinforcing member 32 on folded over surface 16 and adjacent end 20. For the third step, sheet 12 and reinforcing member 32 are stitched together along line 34. The fourth step comprises folding end 18 over reinforcing member 32.

The fifth step comprises enveloping a transparent plastic sheet 50 over bottom edge 44 of planar member 30. The sixth step comprises stitching planar member 30 and transparent sheet 50 along line 55. The seventh step comprises stitching planar member 30 and sheet 50 along lines 56 so as to form a plurality of pockets 58 on both sides of the planar member.

The eighth and final step comprises fastening a pair of clips 70 to planar member 30 adjacent top edge 42 thereof. It can now be seen that the identification badge has been manufactured.

Figure 3:
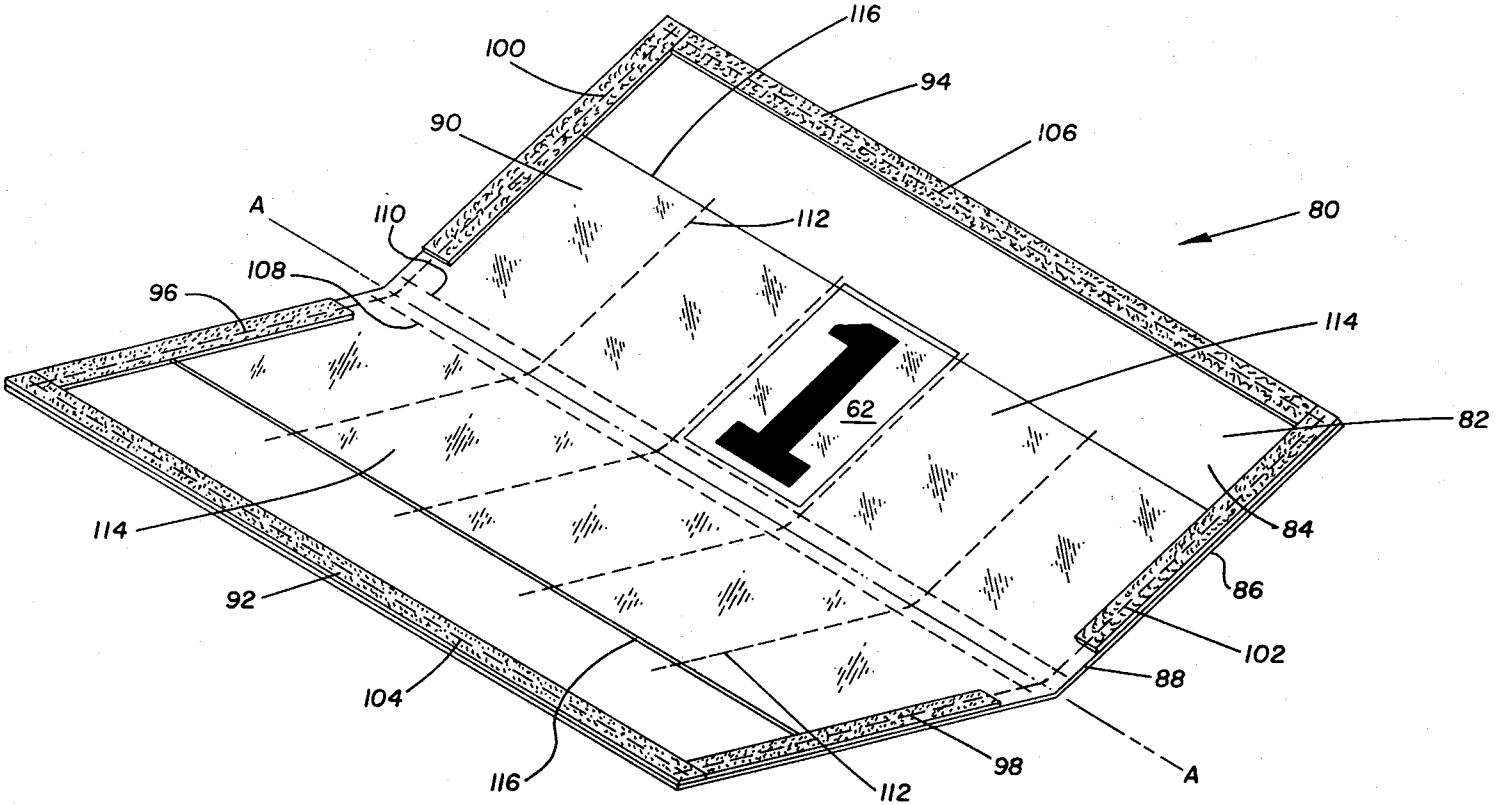
FIG. 3 is a perspective view of the pouch that is associated with the specific embodiment illustrated in FIG. 1.

Referring to FIG. 3, a carrying pouch 80 is illustrated. Pouch 80 includes a pliant sheet 82 having opposite interior 84 and exterior 86 surfaces and a peripheral edge 88. A transparent plastic sheet 90 is centrally positioned on interior surface 84. A pair of corresponding VELCRO strips 92 and 94 are positioned on interior surface 84 adjacent to and along a portion of peripheral edge 88. Sheet 90 and strips 92, 94 overlap along certain portions thereof.

Pliant sheet 82, plastic sheet 90 and strips 92 and 94 are stitched together along lines 96, 98, 100 and 102. Strips 92 and 94 are stitched to pliant sheet 82 along lines 104 and 106, respectively. Pliant sheet 82 and plastic sheet 90 are stitched together in a direction generally parallel to axis A—A along lines 108 and 110, and in a direction generally perpendicular to axis A—A along lines 112.

The stitching together of the pliant and plastic sheets is such that a plurality of oppositely disposed pockets or compartments 114 are formed on the interior surface of the pouch. Each of pockets 114 has an open end 116 via which identification members 62 can be removably positioned within pockets 114. There is sufficient number of pockets 114 such that a complete set of identification members 62 can be contained in pockets 114.

Pouch 80 is of sufficient size so as to accommodate complete reception of identification badge 10. Thus, badge 10 and a complete set of identification members 62 can be carried in pouch 80. The combination of identification badge 10, a set of identification members 62 and pouch 80 comprises an identification badge kit.

While there have been described above the principles of this invention in connection with specific apparatus, it is to be clearly understood that this description is made only by way of example and not as a limitation to the scope of the invention.

What is claimed is:

1. An identification badge for detachable attachment to a wearer comprising:

a generally planar member having opposite surfaces, one of said surfaces faces outwardly from the wearer;

a means, secured to said member, for detachably attaching the badge to the wearer;

a transparent pocket formed in said outwardly facing surface;

an identification member removably positionable within said pocket so as to indicate the identity of the wearer;

the other of said surfaces faces inwardly toward the wearer;

another transparent pocket formed in said inwardly facing surface; and a second identification member positioned within said another pocket so that one identity is indicated by said outwardly facing surface and another identity is indicated by said inwardly facing surface.

2. The identification badge of claim 1 wherein said attaching means comprises a pair of clips secured to said member adjacent the upper edge thereof, said planar member being generally rigid so that upon attachment to the wearer said planar member depends downwardly from the point of attachment thereby presenting said outwardly facing surface.

3. The identification badge of claim 1 further comprising a plurality of said transparent pockets being formed in said outwardly facing surface, and a plurality of said identification members so that one of a plurality of identities can be selectively indicated.

4. The identification badge of claim 1 wherein said planar member is generally rigid so that upon attachment to the wearer the badge depends downwardly from the point of attachment so as to selectively present either said inwardly or outwardly facing surfaces.

5. An identification badge for attachment to a wearer comprising:

a pliant sheet having opposite inwardly and outwardly facing surfaces relative to the wearer and a top edge;

a clip secured to said sheet adjacent said top edge;

a transparent sheet covering a portion of said inwardly and outwardly facing surfaces, said transparent sheet being attached to said pliant sheet so as to form a plurality of transparent pockets on both of said surfaces; and a plurality of identification members selectively positionable within said transparent pockets so that said outwardly facing surface presents one selective identity and said inwardly facing surface presents a second selective identity.

6. The identification badge of claim 5 further comprising:

a carrying pouch having closure means for selectively opening and closing said pouch, a plurality of compartments formed within said pouch, and said plurality of identification members forming a set of said members removably positionable within said compartments.

7. The identification badge of claim 6 wherein there are sufficient number of said compartments formed on said interior surface of said pouch such that a complete set of said identification numbers can be stored therein.

8. The identification badge of claim 7, wherein said compartments are formed by attaching a sheet of transparent material to said interior surface of said pouch so that said compartments permit the viewing and selection of said identification members stored in said compartments when said pouch is open.

9. An identification badge kit comprising:

an identification badge, said badge having opposite surfaces, one of said surfaces faces outwardly from a wearer, a pocket formed in said one surface, a clip secured to said badge, a pouch, said pouch being of a size so as to be capable of receiving said badge, a closure means, secured to said pouch, for selectively opening and closing said pouch, a compartment formed in said pouch, and an identification means, removably positionable within said compartment, for identifying the wearer when positioned within said pocket.

10. The identification badge kit of claim 9 wherein said identification means comprises a plurality of identification members whereby a particular identification for the wearer can be selected and positioned within said pocket.

11. The identification badge kit of claim 9 wherein a plurality of said pockets are formed in said one surface and a plurality of said compartments are formed in said pouch, and said plurality of identification members form an identification set so that a selected one of a plurality of identities can be presented by said one surface.

12. The identification badge kit of claim 9 wherein said compartment is formed by attaching a transparent sheet of material to said interior surface of said pouch so that said compartment permits the viewing and selection of said identification members stored in said compartment.

* * * * *